US006645326B2

(12) United States Patent
Canterberry et al.

(10) Patent No.: US 6,645,326 B2
(45) Date of Patent: Nov. 11, 2003

(54) LOW TEMPERATURE AUTOIGNITION MATERIAL

(75) Inventors: J B Canterberry, Apollo Beach, FL (US); Cezary Grzelczyk, Lakeland, FL (US)

(73) Assignee: Breed Automotive Technology, Inc., Lakeland, FL (US)

( * ) Notice: Subject to any disclaimer, the term of this patent is extended or adjusted under 35 U.S.C. 154(b) by 26 days.

(21) Appl. No.: 10/104,359

(22) Filed: Mar. 25, 2002

(65) Prior Publication Data

US 2003/0178113 A1 Sep. 25, 2003

(51) Int. Cl.[7] ..... C06B 31/00; D03D 23/00
(52) U.S. Cl. ..... 149/45; 149/108.6
(58) Field of Search ..... 149/45, 108.6; 102/205, 275.1, 202, 275.11

(56) References Cited

U.S. PATENT DOCUMENTS 3,266,959 A * 8/1966 Ackley ..... 149/19
5,866,842 A 2/1999 Wilson et al. ..... 149/19.6
5,959,242 A 9/1999 Knowlton et al. ..... 149/38
6,298,784 B1 * 10/2001 Knowlton et al. ..... 102/275.3
6,539,869 B2 * 4/2003 Knowlton et al. ..... 102/275.3

* cited by examiner

*Primary Examiner*—Michael J. Carone
*Assistant Examiner*—Aileen B. Felton
(74) *Attorney, Agent, or Firm*—Jarett Rieger

(57) ABSTRACT

The autoignition compositions of the present invention ignites in the temperature range of 120° C. to 160° C. The autoignition compositions are thermally stable at 107° C. for 400 hours and are thermally stable during thermal cycling. The preferred composition for the autoignition composition comprises equal weight percentages of the following chemicals: nitroguanidine, $Sb_2S_3$, and $AgNO_3$. An ignition temperature adjuster selected from the group consisting of teflon powder, graphite powder, ammonium perchlorate, $MoS_2$, and FeS can be added to the preferred autoignition composition.

4 Claims, No Drawings

LOW TEMPERATURE AUTOIGNITION MATERIAL

FIELD OF THE INVENTION

The present invention relates generally to airbag inflators used to inflate vehicle airbags, and specifically, to an autoignition composition which provides a means for ignition of the gas generant when an inflator is exposed to elevated temperatures.

BACKGROUND

Airbags used in supplemental occupant restraint systems in automobiles require a rapid generation of gas in order to inflate the airbag during a crash. There are two methods currently in use to supply gas for airbag inflation: a compressed stored gas and a combustible pyrotechnic material. This invention relates to the latter, combustible pyrotechnic material. The use of combustible pyrotechnic material involves housing a combustible material in a combustion chamber which has a throttling means to control the combustion pressure and thereby the rate of gas generation. The rate of gas generation for a given gas generant can also be controlled by the amount of initial surface and rate of change of the surface area, as propellant burning takes place perpendicular to the surface. The rate of gas generation determines the rate of inflation of the airbag and the type of protection afforded to the occupant during an automobile crash.

The gas produced by the burning of the gas generant must be non-toxic and meet stringent requirements. Typically, nitrogen is the desired product gas from the combustion process as it is non toxic, of low reactivity, and has a relatively low heat capacity. Nonazide gas generants are currently the preferred type of gas generant. Nonazide gas generants are preferred because they are non-toxic or "green." Nonazide generants typically contain organic or organometallic fuels as oppose to sodium azide, which has been used in the past. The preferred fuels have low amounts of carbon and hydrogen while having higher amounts of nitrogen. Organic/organometallic fuels typically have low melting points. When formulated into gas generant containing certain oxidizer system, organic/organometalic fuels have a problem as they melt or form eutectics at relatively low temperatures. The aforementioned problem becomes a serious issue when these gas generants are subjected to high temperature aging or bonfires.

Airbag inflators are designed to have a minimum weight and operate at relatively high pressures. Lightweight airbag inflators may be made of different types of material ranging from aluminum to stainless steel. Airbag inflators and the gas generant house are designed to function at generally less than 95° C. Melting or distortion of organic/organometallic based gas generant can occur at high temperatures resulting in a perturbation of surface area. Perturbation of the surface area of a gas generant can result in uncontrolled or undefined burning and high pressure in the airbag inflator. In order to insure that an airbag inflator functions in a safe manner at temperatures greater than the normal operating temperature an autoignition material is required.

The terms, "autoignition element," autoignition composition," or autoignition material" mean a material which will spontaneously ignite or combust at a temperature lower than that which would lead to catastrophic failure (i.e. explosion, fragmentation, or rupture) of the airbag inflator upon ignition. Autoignition insures that the airbag inflator function in a safe manner and minimizes risk from deployment at temperatures outside the design limits. Elevated temperatures may be encountered in bonfires and the like. The United States Department of Transportation requires that airbag inflators function in a normal manner in a bonfire in order to obtain a shipping classification. An autoignition element is a material which ignites the gas generant in a means which result in a non-failure of the unit. The ignition takes place between the upper limits set by the end user and the melting, decomposition, or autoignition of the gas generant. An autoignition element may be a single material or a mixture, granular or compressed, formulated to autoignite at a given temperature. The autoignition element must be stable at the upper functioning limit temperature, not decompose or ignite during aging, and still function as the required temperature.

To overcome the potentially catastrophic situation of housing failure, autoignition materials are used which spontaneously combust or ignite at a temperature lower than that which would lead to the failure of the inflator housing.

U.S. Pat. No. 5,959,242 and U.S. Pat. No. 6,101,947 teach the use of metal fuels with various oxidizers in a low temperature autoignition composition.

U.S. Pat. No. 5,866,842 teaches a low temperature autoigniting composition comprising a low temperature melting oxidizer and a fuel, wherein the low temperature autoignition composition autoignites in the temperature range of about 130° C. to 175° C.

SUMMARY OF THE INVENTION

Basic requirements of an autoignition composition for a airbag inflator used in a vehicle occupant restraint system are that the autoignition composition be thermally stable up to 107° C. and posses physical integrity to withstand abrasion and environmental changes. The autoignition compositions of the present invention ignite in the temperature range of 120° C. to 160° C. The preferred composition for the autoignition composition comprises equal weight percentages of NQ, $Sb_2S_3$, and $AgNO_3$.

DETAILED DESCRIPTION OF THE INVENTION

The present invention provides autoignition compositions that are suitable for a variety of gas generating devices, in particular, airbag inflators. The autoignition materials serve the purpose of igniting the gas generant of an inflator during a fire before the heat compromises the structural integrity of the inflator housing or causes the gas generant to undergo a chemical or physical change (i.e. decomposition, melting, and autoignition). Once the autoignition element reaches its autoignition temperature, the fuel and the oxidizer of the autoignition element react exothermically producing an intense flame. The flame from this highly exothermic reaction has sufficient energy to initiate the burning of the booster/and or gas generant. The ignition of the autoignition material allows the gas generator to function safely and in a controlled manner.

The autoignition element of the present invention will autoignite in the temperature range of 120° C. to 160° C. In addition to autoigniting at temperatures less than 160° C., the autoignition materials in the present invention are stable at elevated temperatures as well as during temperature cycling. To satisfy thermal aging requirements, the autoignition material must be stable at 107° C. for 400 hours and still function. The autoignition material must also be stable to cycling through the temperature range of −40° C. to 90°

C. The autoignition compositions of the present invention therefore ensure ignition reliability despite exposure to a wide range of temperatures over the live of the vehicle, which may be ten years or more.

The autoignition elements in the present invention autoignite at temperatures lower than most of the commonly used autoignition elements. For example, nitrocellulose is a typical autoignition element in which it autoignites at a temperature about 185° C. The advantage of the autoignition elements in the present invention having lower autoignition temperatures is that they can be used in conjunction with a gas generant that decomposes, melts, or autoignites at temperatures less than 160° C.

Gas generants that contain ammonium nitrate as an oxidizer have melting points that are generally below 170° C., which is below the autoignition temperatures of many autoignition materials. Ammonium nitrate has many properties that make it highly desirable as an oxidizer for a gas generant. Ammonium nitrate contains no halogens, burns without smoke production, and is less toxic than other conventionally employed oxidizing materials. Also, ammonium nitrate is an inorganic compound that burns completely to a non-toxic gas, leaving no solid residue.

The attractiveness of ammonium nitrate as an oxidizer is reduced because of it low melting point and the ease with which it forms low melting eutectic. As discussed earlier, ammonium nitrate is a highly desirable oxidizer for a gas generant because during combustion, it does not produce any particulates. Ammonium nitrate melts at about 169° C., and the addition of a fuel to the oxidizer may result in a eutectic that has a lower melting point. If the fuel is nitroguanidine or guanidine nitrate the resulting eutectic (fuel and oxidizer) may have a melting point at about 135° C. If the fuel is 5-amino tetrazole, then the eutectic (5-amino tetrazole and ammonium nitrate) may have a melting point as low as 115° C. The autoignition element needs to autoignite below melting temperature of the gas generant to prevent the gas generant from burning in an uncontrolled and unpredictable manner. Thus, for gas generants containing ammonium nitrate, an autoignition material needs to autoignite at a temperature below the melting point of the ammonium nitrate gas propellant.

The autoignition composition for the invention comprises a nitro containing organic compound, a transition metal sulfide, and an oxidizer. The nitro-containing compound is a fuel that is rich with nitrogen and could include but not limited to guanidine nitrate, nitroguanidine, nitro and nitrates of aminotetrazoles , tetrazoles, bitetrazoles, and nitrates. The preferred nitro-containing compound for the present invention is nitroguanidine (hereinafter referred to as "NQ").

The transition metal sulfide could contain any transition metal on the periodical table but the preferred transition metal is Antimony. The oxidizer is selected from the group consisting of metal nitrate and nitrites. The preferred oxidizer is $AgNO_3$.

The preferred autoignition composition for the present invention comprises NQ, $Sb_2S_3$, and $AgNO_3$. An autoignition composition with equivalent weight percentages for NQ, $Sb_2S_3$, and $AgNO_3$ will ignite and burn with an intense flame at approximately 130° C. By adjusting the weight percentages among the three chemicals in the autoignition composition, the autoignition temperature can be varied. Autoignition formulations with unproportional amounts of NQ, $Sb_2S_3$, and $AgNO_3$ will still produce an intense flame that will ignite a booster material and/or gas generant and will also survive thermal aging at 107° C. for 400 hours. The weight percentages for the constituents of the autoignition composition can be 20–60% NQ, 20–60% $Sb_2S_3$, and 20–60% $AgNO_3$.

The autoignition elements may also include other materials that either help catalyze or accelerate the ignition of the autoignition material and/or modify the ignition temperature. Some additional chemicals that can be combined to the autoignition composition include teflon powder, graphite powder, ammonium perchlorate, $MOS_2$, and FeS.

The present invention is illustrated by the following representative examples. All compositions are given in percent by weight.

EXAMPLE 1

The mixing of the autoignition compositions can be accomplished through the use of known equipment in the art. In Example 1, NQ, $Sb_2S_3$, and $AgNO_3$ were ground separately using a Ball mill. The ground chemicals were then added to a paddle tumbler, which is an off axis machine that rolls. Velostat conductive chips with an average diameter of a half an inch were also added to the powder blender. The velostat chips and ground chemicals were mixed for an hour.

Various autoignition compositions were tested to find a composition that ignited at temperatures below 160° C., and greater than 107° C. Sample of autoignition materials are placed in an aluminum pan and dried. The pan, with samples, is then placed on a cool hot plate and the hot place is then turned on and set on high. The hot plate has an attached thermocoupler connecting the hotplate with a temperature measuring device. The temperature measuring device had a digital readout accurate to a tenth of a degree. The heating rate utilized is approximately 2° C. a minute with the autoignition material being observed in the range of 90° C. to 180° C. The ignition temperature determining test is a very rigorous test for autoignition compositions since under such conditions, many compositions slowly decompose under the increasing temperatures and thereby fail to ignite at the desired temperature. Table 1 provides a list of autoignition materials that ignited less than 160° C.

TABLE 1

| Autoignition temperature | Ignition temperature |
|---|---|
| 31.7% NQ/31.7% $Sb_2S_3$/31.7% $AgNO_3$ + 2% teflon powder | 127° C. |
| 31.7% NQ/31.7% $Sb_2S_3$/31.7% $AgNO_3$ + 5% teflon powder | 134° C. |
| 31.7% NQ/31.7% $Sb_2S_3$/31.7% 1 pt. $AgNO_3$ + 5% graphite powder | 144° C. |
| 20% NQ/20% $Sb_2S_3$/20% $AgNO_3$ + 40% ammonium perchlorate | 143° C. |
| 33.3% NQ/9.0% $Sb_2S_3$/33.3% $AgNO_3$ + 25% FeS | 136° C. |
| 30% NQ/30.0% pt. $Sb_2S_3$/30%. $AgNO_3$ + 10% $MoS_2$ | 127° C. |
| 27.7 NQ/27.7 $Sb_2S_3$/27.7 $AgNO_3$ + 16.9% $MoS_2$ | 137° C. |
| 33% NQ/33% $Sb_2S_3$/25% $AgNO_3$ + 9.0% $MoS_2$ | 150° C. |
| 33% NQ/9.0% $Sb_2S_3$/33% pt. $AgNO_3$ + 25% $MoS_2$ | 149° C. |
| 33.3% NQ/33.3% $Sb_2S_3$/33.3% $AgNO_3$ | 117° C. |
| 30.0% NQ/35.0% $Sb_2S_3$/35.0% $AgNO_3$ | 137° C. |
| 25.0% NQ/37.5% $Sb_2S_3$/37.5% $AgNO_3$ | 145° C. |
| 35.0% NQ/35.0% $Sb_2S_3$/30.0% $AgNO_3$ | 134° C. |
| 37.5% NQ/37.5% $Sb_2S_3$/25.0% $AgNO_3$ | 139° C. |
| 35.0% NQ/30.0% $Sb_2S_3$/35.0% $AgNO_3$ | 148° C. |

EXAMPLE 2

One lot of NQ/$Sb_2S_3$/$AgNO_3$ was prepared in order to conduct a series of sensitivity tests. The lot was divided into samples for the purpose of analyzing the sensitivity of the autoignition material. The three sensitivity tests are as follows: electrostatic discharge test, impact test, and BAM friction test.

The electrostatic discharge test provides a method for determining the probability of a substance being ignited by an electrostatic charge carried and stored on equipment and personnel. For this test, a 15 mg sample is placed between two electrodes. The electrodes serve as a capacitor and are charged by running current to one of the electrodes. Twenty samples were tested by the electrostatic discharge tester to determine a Log 50% fire point on the electrostatic discharge tester, utilizing the Bruceton Method. The results are illustrated in Table 2.

The impact test provides a method to determine the impact sensitivity of a substance. For this test, a sample of test material is loaded into a cup. An anvil/plug is placed over the test material and then a weight is dropped on the anvil/plug. The weight is supported by two guides. The sensitivity of the test material is determined by the distance that the weight falls when detonation occurs. The higher the value, the lower the sensitivity. Twenty samples were prepared to achieve a 50% fire point on the Impact Tester using the Bruceton Method. Table 2 provides the results from the impact test.

The friction test provides a method to determine if a substance presents a significant danger of explosion when subjected to friction forces. A sample of approximately 10 mg is placed on a porcelain place so that it is in front and under the porcelain pin. The porcelain plate moves causing friction to be applied to the test sample. If no positive reaction is achieved in six consecutive tests at the highest machine setting (360 Newtons), then >360 newtons is the reported value. The results from this experiment are provided on Table 2.

TABLE 2

| Material | Electrostatic Discharge Test | Impact Test | Friction Test |
|---|---|---|---|
| 33.3% NQ/ 33.3% $AgNO_3$/ 33.3.% $Sb_2S_3$ | >3.439 joules (0.02 capacitor) | >15.38 cm (2 kg) | >360 N |

While the foregoing examples illustrate and describe the use of the present invention, they are not intended to limit the invention as disclosed in certain preferred embodiments herein. Therefore, variations and modifications commensurate with the above teachings and the skill and knowledge of the relevant, are within the scope of the present invention.

We claim:

1. An autoignition composition for use in a gas generating device comprising:

a) a fuel at 20–60% by weight selected from a group consisting of nitroguanidine, aminotetrazoles, tetrazoles, bitetrazoles, and nitrates;

b) a transition metal sulfide at 20–60% by weight, and c) an oxidizer at 20–60% by weight selected from the group consisting of metal nitrates and nitrites.

2. An autoignition composition according to claim 1, wherein the composition autoignites in a temperature range of 120° C. to 160° C.

3. An autoignition composition according to claim 1, wherein said fuel is nitroguanidine, said transition metal sulfide is $Sb_2S_3$, and oxidizer is $AgNO_3$.

4. An autoignition composition according to claim 1 further comprising an ignition temperature adjuster selected from the group consisting of teflon powder, graphite powder, ammonium perchlorate, $MoS_2$, and FeS.

* * * * *